United States Patent [19]

Nankee et al.

[11] Patent Number: 4,809,761

[45] Date of Patent: Mar. 7, 1989

[54] PROCESS FOR PRODUCING MOLDS OR CORES FOR INVESTMENT CASTING WITH REDUCED SOLVENT LOSS

[75] Inventors: Robert J. Nankee; E. Richard Randolph, both of Midland, Mich.

[73] Assignee: The Dow Chemical Company, Midland, Mich.

[21] Appl. No.: 142,986

[22] Filed: Jan. 12, 1988

[51] Int. Cl.[4] ..... B22C 9/02

[52] U.S. Cl. ..... 164/5; 164/44; 164/36

[58] Field of Search ..... 164/36, 516, 5, 44, 164/34, 35

[56] References Cited

U.S. PATENT DOCUMENTS

| | | |
|---|---|---|
| Re. 31,488 | 1/1984 | Trumbauer . |
| 3,094,751 | 6/1963 | Horton . |
| 3,226,785 | 1/1966 | Moxlow et al. . |
| 3,254,379 | 6/1966 | Poe . |
| 3,339,620 | 9/1967 | Krzyzanowski et al. . |
| 3,339,622 | 9/1967 | Horton . |
| 3,374,827 | 3/1968 | Schebler . |
| 3,410,942 | 11/1968 | Bayer . |
| 3,526,266 | 9/1970 | Snelling . |
| 3,857,435 | 12/1974 | Burkert et al. . |
| 4,462,453 | 7/1984 | Trumbauer . |
| 4,469,720 | 9/1984 | Morris . |

*Primary Examiner*—Kuang Y. Lin

[57] ABSTRACT

In an investment casting process wherein molds or cores are prepared by forming them around a polymer pattern and then dissolving the pattern with a solvent, solvent losses can be reduced by heating the mold or core before contacting it with the solvent to reduce the amount of solvent adsorbed in the mold or core. An improved process comprises: (a) forming the mold or core around the pattern; (b) heating the mold or core; (c) dunking or spraying the mold or core with the solvent until the pattern is dissolved; (d) placing the mold or core in a drying chamber in the path of circulating heated air; (e) cooling the air to condense the solvent; (f) recovering the condensed solvent; and (g) reheating the air until it is no longer saturated with solvent and recycling the air to the drying chamber. The preliminary heating step can reduce solvent losses by 66 percent and the entire improved process can reduce solvent losses by about 90 percent.

20 Claims, No Drawings

PROCESS FOR PRODUCING MOLDS OR CORES FOR INVESTMENT CASTING WITH REDUCED SOLVENT LOSS

BACKGROUND OF THE INVENTION

The present invention relates to the art of casting and more particularly to the art of casting metals using a mold or core produced by the investment casting method.

Metal is cast by pouring the molten metal into a mold, possibly containing a core, made of a porous or particulate material such as sand. Other materials can be cast by similar means using molds of known porous substances such as plaster or even paper fiber. One popular method of preparing molds or cores for casting is the "investment casting' method.

In an investment casting process, a model of the item to be cast, called a pattern, is shaped from a destructible material such as polymer foam. The mold or core is shaped from sand around the pattern. The polymer pattern is then destroyed by a method which leaves the mold or core bearing its impression intact. Such processes are described in Horton, *Method of Form Removal from Precision Casting Shells,* U.S. Pat. No. 3,094,751 (June 25, 1963); Moxlow, *Metal Casting Using Destructible Pattern,* U.S. Pat. No. 3,226,785 (Jan. 4, 1966); Poe, *Expandable Molding Shape for Precision Casting,* U.S. Pat. No. 3,254,379 (June 7, 1966); Horton, *Method of Removing Patterns from Investment Molds,* U.S. Pat. No. 3,339,622 (Sept. 5, 1967); Bayer, *Casting Method,* U.S. Pat. No. 3,410,942 (May 24, 1968); Snelling, *Mold for the Casting of Metals,* U.S. Pat. No. 3,526,266 (Sept. 1, 1970); Burkett et al., *Process for Making Soluble Cores,* U.S. Pat. No. 3,587,435 (Dec. 31, 1974); Trumbauer, *Casting Methods with Composite Molded Core Assembly,* U.S. Pat. No. Re. 31,488 (Jan. 10, 1984); Trumbauer, *Casting Methods with Composite Molded Core Assembly,* U.S. Pat. No. 4,462,453 (July 31, 1984).

The pattern can be destroyed by known methods such as melting, decomposition or contacting with molten metla, but a preferred method is to contact the pattern with a solvent capable of dissolving it. See supra Horton U.S. Pat. No. 3,094,751, Poe U.S. Pat. No. 3,254,379, Horton U.S. Pat. No. 5,339,622, Bayer U.S. Pat. No. 3,410,942 and Trumbauer U.S. Pat. No. 4,462,453. When the mold or core is contacted with solvent, some solvent is drawn into it and becomes adsorbed upon the sand or other mold or core material. The presence of solvent in the mold or core is undesirable for several reasons. When casting metal, the heat from the molten metal causes the solvent to form a gas, which can crack the mold or core or cause bubbles in the cast item. Molten metal may react with the solvent, for instance by forming hydrochloric acid from chlorinated aliphatic solvents. The solvent may escape from the mold or core into the environment, posing a health threat to workers and the general public. Finally, the solvent may be too expensive to lose substantial amounts with each mold or core.

Solvent-treated molds and cores are currently dried either by heating or by subjecting to reduced pressures or both. Solvent thus driven off can be scrubbed from the entraining air by passing the mixture through carbon adsorption beds. That system has numerous faults. Used carbon beds can not be regenerated infinitely but must eventually be disposed of in an environmentally sound manner. Moreover, common chlorinated solvents such as 1,1,1-trichloroethane can react while in the bed to form hydrochloric acid which damages the adsorption equipment. Furthermore, since the efficiency of carbon beds is less than 100 percent, a system which sends large amounts of solvent to the carbon beds will lose more solvent into the environment than one which sends lesser amounts to the adsorption beds. All of those problems can be minimized by reducing the flow of solvent into the carbon beds.

What is needed is a process to produce the molds and cores which minimizes the amount of solvent retained in them and recovers a substantial portion of the solvent which is retained in a reusable fashion.

SUMMARY OF THE INVENTION

In one aspect, the present invention is a process for making molds or cores comprising the steps of:

(a) fashioning a mold or core of porous or particular material around a pattern comprising a solid material which can be dissolved in a solvent;

(b) heating the mold or core to a temperature at which retention of that solvent in the mold or core is substantially reduced; and (c) contacting the pattern with the solvent under conditions and in amounts sufficient to dissolve the pattern while the mold or core's temperature is high enough to substantially reduce retention of solvent in the mold or core.

In another aspect, the present invention is a process for preparing molds or cores comprising the steps of:

(a) fashioning a mold or core of porous or particulate material around a pattern comprising a solid material which can be dissolved in a solvent;

(b) heating th emold or core to a temperature at which retention of that solvent in the mold or core is substantially reduced;

(c) contacting the pattern with the solvent in such amounts and under such conditions that the pattern is dissolved while the mold or core's temperature is high enough to substantially reduce retention of solvent in the mold or core;

(d) contacting the mold or core with a gas stream at a temperature and pressure sufficient to vaporize the solvent remaining in or on the mold or core;

(e) cooling the solvent laden gas to a temperature at which at least some of the solvent condenses;

(f) recovering the condensed solvent; and (g) reheating the gas to a temperature at which it is no longer saturated with solvent and recycling to step (d).

By preheating the mold, solvent retention in the mold or core can be reduced by approximately 66 percent. By stripping off the remaining solvent with gas that is subsequently cooled and then reheated and recycled, a further 66 percent of the solvent remaining in the mold or core can be recovered in reusable form. Thus, the amount of solvent going to the carbong adsorption beds can be reduced by approximately 90 percent.

DETAILED DESCRIPTION OF THE INVENTION

In a process of the present invention, a mold or core is formed around a pattern comprising a solid material which can be dissolved by contact with a solvent. The pattern preferably comprises a soluble polymer; more preferably, a polystyrene, polycarbonate or a copolymer such as ABS. The pattern most preferably comprises polystyrene.

The mold or core formed around the pattern comprises a porous and/or particulate material. The material can be any substance known in the art to be useful for forming molds or coares, for instance, sand or plaster. If the mold or core is to be used to cast metal, it preferably comprises sand. Particulate materials are often mixed with binders or active agents. Any other component known in the art to be useful in forming molds or cores may be used in a process of the present invention.

Thereafter the pattern is contacted with a sufficient amount of solvent to substantially dissolve the pattern. The exact solvent will depend upon what material was used to form the pattern. The pattern material and solvent are preferably chosen so that the pattern will completely dissolve after only brief contact (usually between about 10 seconds and about 5 minutes) with the solvent. The solvent is highly preferably an organic solvent. Organic solvents may be aromatic, such as benzene or toluene; acyl, such as acetone; or aliphatic, such as methylene chloride, carbon tetrachloride, hexane or 1,1,1-trichloroethane. The solvent is more highly prefeably halogenated aliphatic and most preferably 1,1,1-trichloroethane.

The pattern may be contacted with the solvent by any known method such as by spraying or dunking the mold or core or by other methods. The mold or core and pattern are preferably dunked in solvent for a time long enough to substantially dissolve the pattern, and afterwards it is preferably sprayed with sufficient solvent to wash away any remaining pattern. When the pattern comprises polystyrene and the solvent is 1,1,1-trichloroethane, the dunking is preferably at least about five seconds; more preferably at least about ten seconds. The mold or core is preferably sprayed with no less than about one to two gallons of solvent. The solvent itself may be heated to increase solubility of the pattern, as long as substantial solvent remains in a liquid form.

Preferred methods and materials for preparing the pattern, preparing the mold or core and dissolving the pattern are also described in the Horton U.S. Pat. No. 3,094,751, Poe U.S. Pat. No. 3,254,379, Horton U.S. Pat. No. 3,339,622, Bayer U.S. Pat. No. 3,410,942 and Trumbauer U.S. Pat. No. 4,462,453 references, which are incorporated herein by reference. The Trumbauer U.S. Pat. No. 4,462,453 reference is particularly relevant.

To minimize retention of the solvent in the mold or core, it is heated prior to contacting with the solvent to a temperature at which retention of the solvent is substantially reduced. The temperature is preferably above the boiling point of the solvent, more preferably at least about 10° C. above the boiling point of the solvent. The temperature is preferably at most below the decomposition temperature of the solvent and the material which makes up the pattern, more preferably below the metling temperature of the pattern. If the pattern melts in the mold or core it is more difficult to remove, and can later interfere with the casting. When the pattern is made of polystyrene and the solvent is 1,1,1-trichloroethane, the temperature of the mold or core is preferably at least about 74° C., more preferably at least about 80° C., and preferably at most about 120° C., more preferably at most about 100° C.

Heating may be accomplished by known dry methods, such as inductive, conductive, radiant or other methods. Preferably the mold or core is imply placed in a recirculating air oven for a time sufficient to achieve about the desired temperature. Thereafter, the pattern should be contacted with the solvent while the mold or core is still at about the desired temperature.

Preferably the mold or core remains at an adequate temperature due to retained heat without the need for further heating during contact with the solvent. To minimize cooling of the mold or core and retention of solvent, the mold or core is preferably not left in contact with the solvent for longer than necessary to dissolve the pattern. When the mold or core is dunked and sprayed to remove a polystyrene pattern using 1,1,1-trichloroethane, the dunking is preferably not more than about five minutes, more preferably not more than about one minute, and most preferably not more than about thirty seconds; and the spraying is preferably not more than about ten minutes and more preferably not more than about two minutes.

Heating the mold or core before contact with the solvent can, by itself, reduce solvent losses by about 66 percent. Those losses can be further improved by drying the molds or cores with a system that recovers the solvent in a usable form. In a preferred system, the molds or cores are placed in a drying chamber where they are contacted with a stream of gas which is inert with respect to the mold or core and solvent under process conditions; for example, nitrogen, carbon dioxide or air. The stream is preferably air. The gas flowing from the drying chamber is cooled to condense at least some of the solvent, and the condensed solvent is recovered. The gas is then reheated until it is no longer saturated with solvent. The reheated gas is returned to the drying chamber.

Systems such as the one described above are well known and are described, for instance, in Morris, *Solvent Recovery System,* U.S. Pat. No. 4,469,720 (Sept. 4, 1984) (the Morris patent also teaches use of a spray scrubber which is neither required nor forbidden in the present application). Optimum temperatures for each step of the solvent recovery process will vary depending upon the solvent and the gas used. Those temperatures can easily be ascertained by experimentation. Pressures in the system may be subatmospheric or superatmospheric, but are conveniently about ambient pressure.

When the solvent is 1,1,1-trichloroethane and the gas used is air, the air in the drying chamber is preferably at least about 60° C.; more preferably, at least about 75° C.; and most preferably, at least about 100° C. The air in the condenser is preferably cooled to at most about 40° C.; more preferably, at most about 10° C. The air preferably flows at at least about one foot per second; more preferably at least about two feet per second. The maximum air flow is limited by practical considerations, but is preferably about four feet per second. In its most preferred embodiments, such a system can recover about 66 percent of the solvent retained by the mold or cores. When combined with the prehetaing step, the process can reduce by about 90 percent the amount of solvent which passes to the carbon adsorption beds.

ILLUSTRATIVE EXAMPLES

The following examples are given for illustrative purposes only and are not intended to be taken as limiting the scope of either the specification or the claims.

EXAMPLE 1

Solvent Retention Reduced by Preheating

A core is formed from 17 pounds of sand with a binder around a pattern of 0.12 pound of polystyrene foam. The core is heated in an oven to about 165° F. (74° C.). Immediately thereafter, the core is placed in the vapor zone of a degreaser filled with 1,1,1-trichloroethane. The core is immersed for about ten seconds in 1,1,1-trichloroethane which has been heated to about 74° C. The core is then sprayed with about two gallons of 1,1,1-trichloroethane over a period of about ten to thirty seconds to rinse any remaining polystyrene from the mold cavity. The core is immediately weighed to determine the weight of solvent retained in the core. The process is repeated at 185° F. (85° C.), 220° F. (104° C.), and 265° F. (129° C.). The results, showing the dry weight of sand used in the core, the total weight of retained solvent and core after the process, the amount of solvent retained in each core, and the weight of solvent retained per weight of sand used, are reported hereafter in Table I.

TABLE I

| Core Temp (°F.) | Sand Weight (lb) | Weight of Core & Solvent | Weight of Retained Solvent | lb Solvent Retained per lb Core |
|---|---|---|---|---|
| 165 | 17.0 | 20.7 | 3.7 | .22 |
| 185 | 17.0 | 18.5 | 1.5 | 0.09 |
| 220 | 17.0 | 17.75 | 0.75 | 0.04 |
| 265 | 17.0 | 17.17 | 0.17 | 0.01 |

EXAMPLE 2

Solvent Loss Minimization

A core weighing about 8.6 kg (19 lb) with a polystyrene pattern is heated to about 85° C. (185° F.) and sprayed with 1,1,1-trichloroethylene are described in Example 1 until the polystyrene pattern is completely dissolved. The core contains about 0.34 kg (about ¾ lb) of solvent.

The core is placed in a drying oven into which recirculating air is being blow at a temperature of about 93° C. (200° F.). Pressure in the oven is maintained at just slightly (about ½ inch water) below ambient pressure to prevent escape of solvent form the oven. The core remains in the oven until essentially all of the solvent retained therein has evaporated. Air from the oven, at a temperature of about 74° C. (165° F.), passes through a blower into a condenser where it is cooled to a temperature of about 9.4° C. (49° F.). Condensed solvent passes out of the condenser at a temperature of about 8.5° C. (47° F.) to a collection tank. Air passes from the condenser to a vapor heater, where it is heated to about 93° C. (200° F.) and returned to the drying oven. Cores exit from the oven along with an exit air stream. The exit air stream is passed through a carbon adsorption bed.

If 300 cores pass through the oven in an hour, about 103 kg (226 lb) of solvent is evaporated from the cores in an hour, about 98.9 kg (218 lb) of solvent is recovered in the collection tank and about 3.6 kg (8 lb) of solvent exits to the carbon bed. Those figures equal about 12 g (½ ounce) of solvent per core passing to the carbon bed.

What is claimed is:

1. A process for making molds or cores comprising the steps of:

(a) fashioning a mold or core of porous or particulate material around a pattern comprising a solid material which can be dissolved in a solvent;

(b) heating the mold or core, prior to contact with the solvent, to a temperature at which retention of that solvent in the mold or core is substantially reduced; and (c) contacting the pattern with the solvent under conditions and in amounts sufficient to dissolve the pattern while the mold or core's temperature is high enough to substantially reduce retention of solvent in the mold or core.

2. A process for making molds or cores comprising the steps of:

(a) fashioning a mold or core of porous or particulate material around a pattern comprising a solid material which can be dissolved in a solvent;

(b) heating the mold or core, prior to contact with the solvent, to a temperature above the boiling point of the solvent and no more than about the decomposition temperature of the solvent or soluble solid material; and (c) contacting the pattern with the solvent under conditions and in amounts sufficient to dissolve the pattern while the mold or core's temperature is high enough to substantially reduce retention of solvent in the mold or core.

3. The process of claim 1 wherein the pattern is formed of a polymer composition.

4. The process of claim 3 wherein the mold or core is heated to a temperature less than the melting temperature of the polymer composition that makes up the pattern.

5. The process of claim 4 wherein the solvent is an organic liquid.

6. The process of claim 5 wherein the pattern is formed of polystyrene.

7. The process of claim 6 wherein the solvent is a halogenated alkane.

8. The process of claim 7 wherein the solvent is 1,1,1-trichloroethane.

9. The process of claim 8 wherein the mold or core is heated to a temperature between about 80° C. and 100° C.

10. The process of claim 9 wherein the mold or core is formed of a particulate composition comprising sand.

11. A process for preparing molds or cores comprising the steps of:

(a) fashioning a mold or core of porous or particulate material around a pattern comprising a solid material which can be dissolved in a solvent;

(b) heating the mold or core, prior to contact with the solvent, to a temperature at which retention of that solvent in the mold or core is substantially reduced;

(c) contacting the pattern with the solvent in such amounts and under such conditions that the pattern is dissolved while the mold or core's temperature is high enough to substantially reduce retention of solvent in the mold or core;

(d) contacting the mold or core with a gas stream at a temperature and pressure sufficient to vaporize the solvent remaining in or on the mold or core;

(e) cooling the solvent laden gas to a temperature at which at least some of the solvent condenses;

(f) recovering the condensed solvent; and (g) reheating the gas to a temperature of which it is no longer saturated with solvent and recycling to step (d).

12. A process for preparing molds or cores comprising the steps of:

(a) fashioning a mold or core of porous or particulate material around a pattern comprising a solid material which can be dissolved in a solvent;

(b) heating the mold or core, prior to contact with the solvent, to a temperature no less than about the boiling point of the solvent and no more than the decomposition temperature of the pattern and solvent;

(c) contacting the pattern with the solvent in such amounts and under such conditions that the pattern is dissolved while the mold or core's temperature is high enough to substantially reduce retention of solvent in the mold or core;

(d) contacting the mold or core with a gas stream at a temperature and pressure sufficient to vaporize the solvent remaining in or on the mold or core;

(e) cooling the solvent laden gas to a temperature at which at least some of the solvent condenses;

(f) recovering the condensed solvent; and (g) reheating the gas to a temperature at which it is no longer saturated with solvent and recycling to step (d).

13. The process of claim 12 wherein the pattern is formed of a polymer composition.

14. The process of claim 13 wherein the mold or core is heated to a temperature less than the melting temperature of the polymer composition that makes up the pattern.

15. The process of claim 14 wherein the solvent is an organic liquid, and the gas used to recover the solvent is air.

16. The process of claim 15 wherein the pattern is formed of polystyrene.

17. The process of claim 16 wherein the solvent is a halogenated alkane.

18. The process of claim 17 wherein the solvent is 1,1,1-trichloroethane, and wherein the air used to recover the solvent is heated to at least about 60° C. and the cooled to no more than about 40° C.

19. The process of claim 18 wherein the mold or core is heated to a temperature between about 80° C. and 100° C., and wherein the air used to recover the solvent is heated to at least about 75° C. and then cooled to no more than about 10° C.

20. The process of claim 19 wherein the mold or core is formed of a particulate composition comprising sand, and wherein the air used to recover the solvent is heated to at least about 100° C.

* * * * *